US006062220A

United States Patent [19]

Whitaker et al.

[11] Patent Number: 6,062,220

[45] Date of Patent: May 16, 2000

[54] REDUCED FOGGING ABSORBENT CORE FACE MASK

[75] Inventors: James F. Whitaker, Alexander; Brian G. Hoge, Fletcher, both of N.C.

[73] Assignee: American Threshold Industries, Inc., Enka, N.C.

[21] Appl. No.: 09/037,492

[22] Filed: Mar. 10, 1998

[51] Int. Cl.[7] ..... A62B 18/00

[52] U.S. Cl. ..... 128/206.19; 128/206.12

[58] Field of Search ..... 128/206.14, 206.17, 128/206.24, 206.25, 206.19, 205.27, 205.29, 206.12, 206.16, 206.21, 206.22, 863, 205.25

[56] References Cited

U.S. PATENT DOCUMENTS

| | | | |
|---|---|---|---|
| 3,603,315 | 9/1971 | Becker, III . | |
| 4,170,515 | 10/1979 | Lalancette et al. . | |
| 4,215,692 | 8/1980 | Levesque . | |
| 4,226,237 | 10/1980 | Levesque . | |
| 4,305,393 | 12/1981 | Nguyen . | |
| 4,319,567 | 3/1982 | Magidson . | |
| 4,507,122 | 3/1985 | Levesque . | |
| 4,600,002 | 7/1986 | Maryyanek et al. . | |
| 4,616,647 | 10/1986 | McCreadie . | |
| 4,618,496 | 10/1986 | Braseur . | |
| 4,619,948 | 10/1986 | Kennedy et al. . | |
| 4,628,927 | 12/1986 | Ward . | |
| 4,641,645 | 2/1987 | Tayebi . | |
| 4,643,182 | 2/1987 | Klein . | |
| 4,662,005 | 5/1987 | Grier-Idris . | |
| 4,676,871 | 6/1987 | Cadieux et al. . | |
| 4,856,509 | 8/1989 | Lemelson . | |
| 4,944,294 | 7/1990 | Borek, Jr. | 128/206.19 |
| 5,012,805 | 5/1991 | Muckerheide . | |
| 5,296,290 | 3/1994 | Brassington . | |
| 5,425,380 | 6/1995 | Hudson et al. | 128/858 |
| 5,620,785 | 4/1997 | Watt et al. | 128/206.12 |
| 5,722,482 | 3/1998 | Buckley | 252/70 |

*Primary Examiner*—John G. Weiss
*Attorney, Agent, or Firm*—Carter & Schnedler, P.A.

[57] ABSTRACT

A disposable face mask with improved moisture control characteristics to reduce the uncomfortable buildup of perspiration and to avoid fogging of eyeglasses or an attached eyeshield. The mask body includes at least an inner layer, worn next to the wearer's face, and a generally coextensive outer layer. An absorbent core is located between the layers, of lesser extent than the mask layers, and positioned so that at least a portion of an intermediate region of the mask is unobstructed by the absorbent core. As examples, the absorbent core may be made of wood pulp or wood pulp blend nonwoven, either of which may be impregnated with super absorbent (SAP). As another example, the absorbent core may be made of peat moss. The absorbent core may be made of a woven material such as cotton, a nonwoven material with absorbent characteristics, or a combination of both. The inner layer is immediately adjacent the absorbent core, and is made for example of a nonwoven fabric designed to "wick" moisture into the absorbent core. The inner layer may be zone treated so as to be hydrophilic in areas of the intermediate region which are overlapped by the absorbent core, hydrophobic in areas of the intermediate region which are unobstructed by the absorbent core, or both hydrophilic in areas of the intermediate region which are overlapped by the absorbent core and hydrophobic in areas of the intermediate region which are unobstructed by the absorbent core.

17 Claims, 4 Drawing Sheets

REDUCED FOGGING ABSORBENT CORE FACE MASK

BACKGROUND OF THE INVENTION

The present invention relates generally to disposable face masks, and more particularly, to face masks with improved moisture control characteristics.

Disposable face masks are nearly universally worn by health care personnel, despite their inconvenience and lack of comfort in many instances. One problem associated with face masks is moisture. One source of moisture is perspiration. Another is the wearer's exhaled breath. Such moisture can result in the fogging of eyeglasses when worn, similar fogging of eyeshield which are attached to some masks to deflect splashed bodily fluids, as well as the uncomfortable buildup of moisture on the face of the wearer.

SUMMARY OF THE INVENTION

Accordingly, an object of the invention is to absorb moisture generation from the face, such as perspiration, as well as from condensed moisture in the breath.

A related object of the invention is to provide a disposable face mask with improved moisture control characteristics, for reducing fogging of a face shield or the eyeglasses of the wearer, as well as for reducing the amount of uncomfortable perspiration and other moisture buildup on the face of the wearer.

Briefly, a face mask includes a mask body having a top, a bottom, sides and an intermediate region. The mask body is multilayered, and includes at least an inner layer and a generally coextensive outer layer. Typically, although not necessarily, there are three layers, an inner facing layer in contact with the face of the wearer, an intermediate filter media layer, and an outer facing layer, all coextensive. The coextensive layers have the appearance of a single sheet of material, which may be folded in different configurations, such as the conventional pleated face mask configuration, with the layers maintaining their coextensiveness.

In accordance with the invention, there is an absorbent core between the inner and outer layers, and thus adjacent the inner layer. On a three-layer mask construction, the absorbent core is located between the inner facing layer and the filter media layer. The absorbent core is of lesser extent than the layers, and is positioned so that at least a portion of the intermediate region is unobstructed by the core. In one embodiment, the absorbent core is positioned adjacent the mask body top. In another embodiment, there are a pair of absorbent cores positioned adjacent the mask body top and bottom, respectively. In yet another embodiment, the absorbent core extends in the manner of a frame around the unobstructed portion of the intermediate region, adjacent the mask body, top, bottom and sides.

A variety of materials may be employed for the absorbent core. One example is wood pulp or wood pulp blend nonwoven, for example, tissue, airlaid pulp or cellulose. Another example is wood pulp or wood pulp blend nonwoven, impregnated with super absorbent polymer (SAP). The absorbent polymer core may be made of a woven material such as cotton, a nonwoven material with absorbent characteristics, or a combination of both. Yet another example is peat moss, a material which is employed as an absorbent in various prior art products such as diapers, incontinence pads, sanitary napkins and wound dressings.

The inner layer is immediately adjacent the absorbent core, and is made for example of a nonwoven fabric designed to "wick" moisture into the absorbent core. Thus, the inner layer is wicking from the side adjacent the absorbent core so as to wick moisture away from the face of the wearer into the absorbent core.

In addition, the inner layer preferably is zone treated so as to be hydrophilic in areas of the intermediate region which are overlapped by the absorbent core, hydrophobic in areas of the intermediate region which are unobstructed by the absorbent core, or both hydrophilic in areas of the intermediate region which are overlapped by the absorbent core and hydrophobic in areas of the intermediate region which are unobstructed by the absorbent core.

The absorbent core is particularly useful in mask constructions including an eyeshield, which is subject to fogging. An eyeshield typically takes the form of a transparent plastic sheet affixed to the mask body on the outside of the outer layer, extending upwardly past the mask body top and downwardly from the mask body top over a portion of the mask body intermediate region. The absorbent core of the invention is then positioned adjacent the mask body top within at least a portion of the portion of the mask body intermediate region over which the eyeshield extends.

BRIEF DESCRIPTION OF THE DRAWINGS

While the novel features of the invention are set forth with particularity in the appended claims, the invention, both as to organization and content, will be better understood and appreciated, from the following detailed description, taken in conjunction with the drawings, in which:

DETAILED DESCRIPTION

Figure 1:
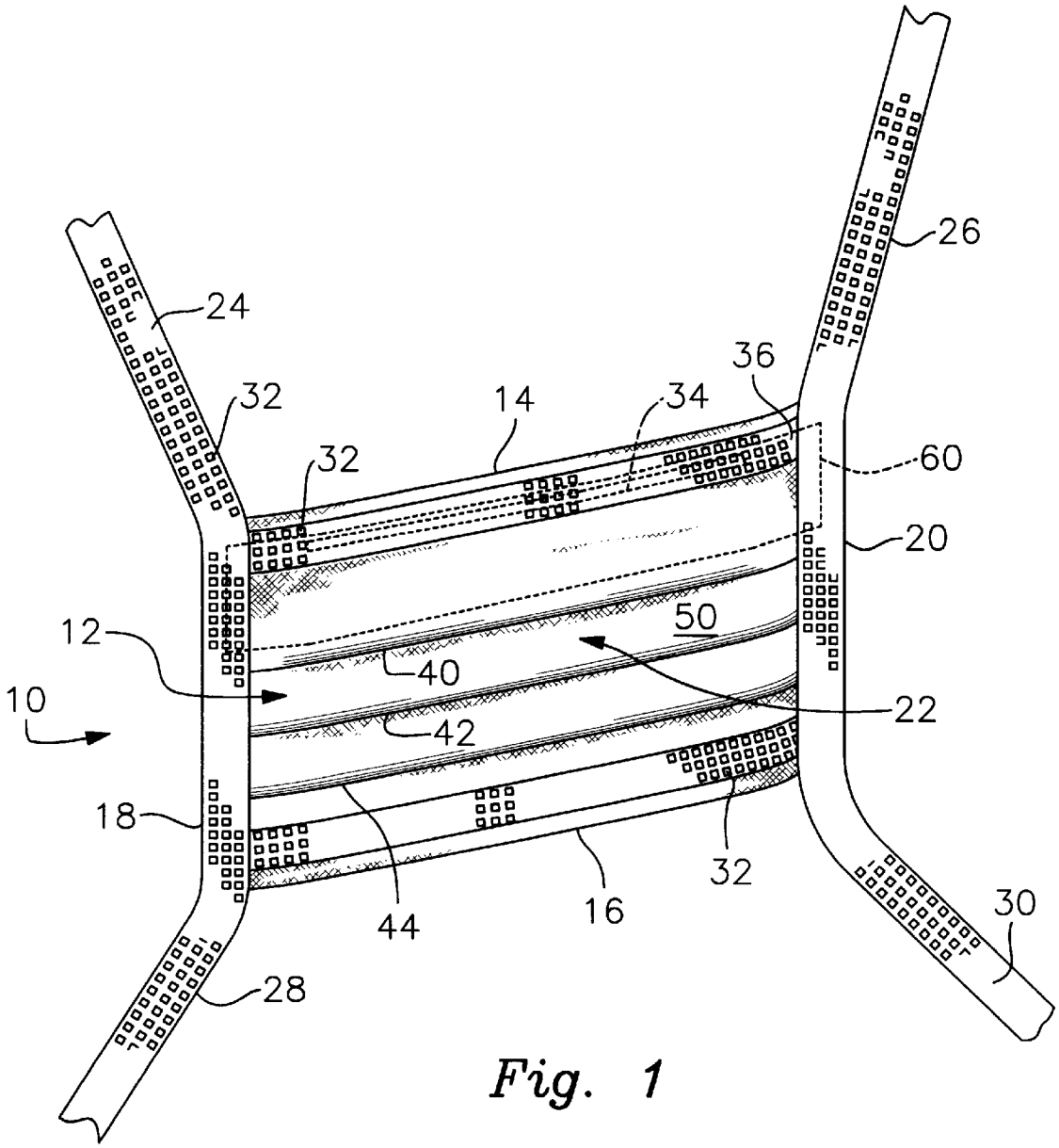
FIG. 1 is a three-dimensional view of a pleated face mask including an absorbent core in accordance with the invention, the location of which is indicated by broken lines.

In FIG. 1, a face mask 10 includes a mask body 12, having a top 14, a bottom 16, sides 18 and 20, as well as an intermediate region 22. Representative ties 24, 26, 28 and 30 are attached to the corners of the mask body 12. Alternatively, earloops, a headband, or another attachment may be employed. The mask body 12 is hemmed at the top 14 and bottom 16, and ribbon-like strips comprising the ties 24, 28 and 26, 30 are folded over along the sides 18 and 20. The mask 10 is held together by means of conventional ultrasonic bonding, as represented by individual ultrasonic bond dimples 32. Other ultrasonic bonding patterns may as well as employed To facilitate maintaining the top edge 14 in conformity with the shape of the nose of a wearer, a conventional malleable nose piece 34 is provided, shown in phantom, retained by an overlying piece of retaining strip material 36, which may be any nonwoven material such as spun-bonded polypropylene, attached by ultrasonic bonding.

The mask 10 illustrated in FIG. 1 is a pleated face mask having pleats 40, 42, and 44 which allow the body 12 of the face mask to expand outwardly, so as to loosely cover the mouth and nose of a wearer. The mask material of the mask body 12 is rectangular both before and after pleating. The invention, however, is not limited to pleated-type face masks.

Figure 3:
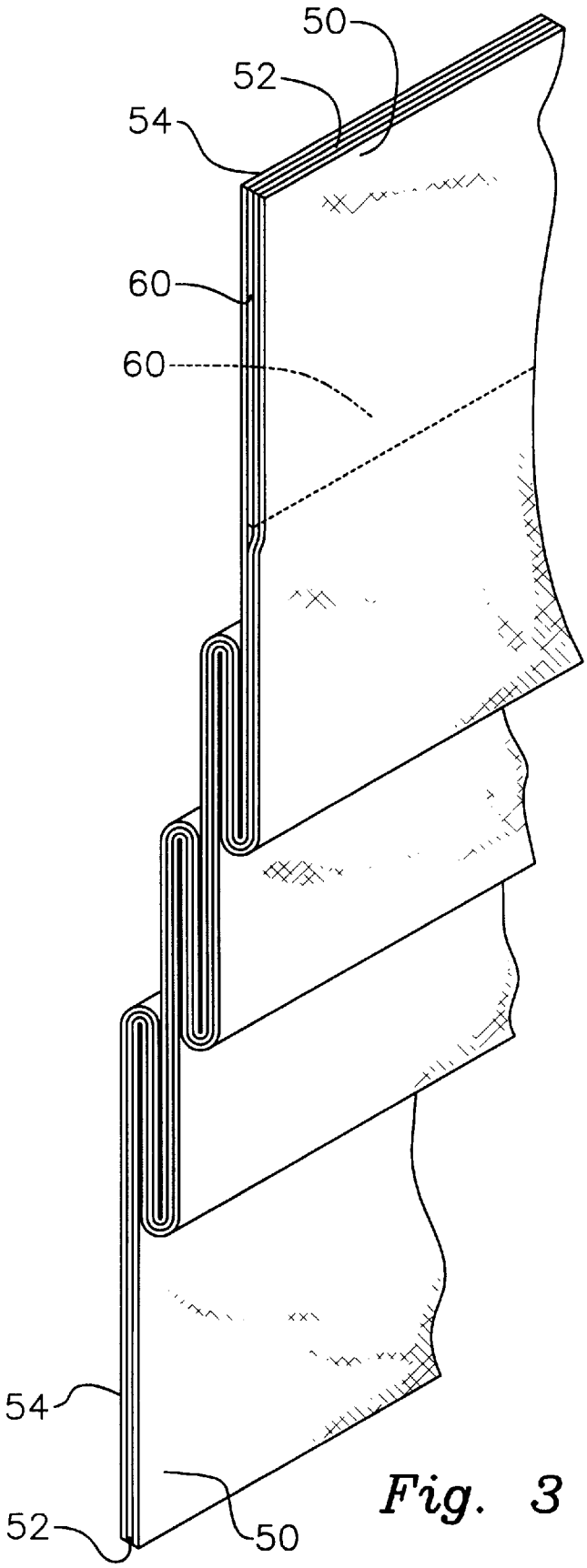
FIG. 3 is a cross-sectional view.
Figure 4:
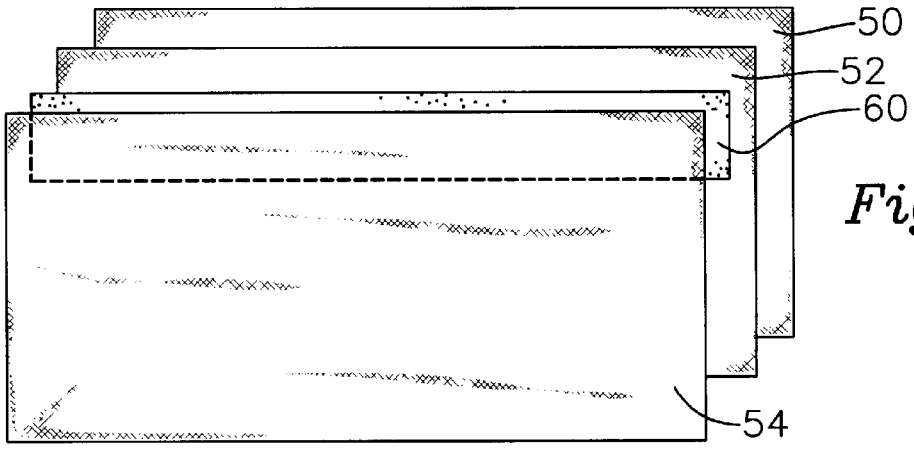
FIG. 4 is an exploded representation showing one embodiment of the absorbent core, corresponding to the position represented in FIGS. 1 and 2.

With reference also to FIGS. 3 and 4, the mask body 12 has a plurality of coextensive layers, an outer facing layer 50, an intermediate filter media layer 52 and an inner facing layer 54, portions of which contact the face of the wearer. Various materials may be employed. As examples, the inner 54 and outer 50 facings can be made of any number of materials, such as nonwoven polyethylene, polypropylene, cellulose, tissue, rayon or polyester, made by a process such as meltblowing, spun-bonding, carding, film extrusion and perforation, or hydroentanglement. The facings 50 and 54 can be a number of different types, or bicomponent fibers, resins, or processes. A suitable material for the filter media layer 52 is meltblown polypropylene. Although three layers 50, 52 and 54 are shown, in accordance with the invention all that are required are the inner layer 54 and the outer layer 50.

Located between the inner 54 and outer 50 layers and, more particularly, between the inner facing layer 54 and the filter media layer 52, is an absorbent core 60 which is of lesser extent in area than the layers 50, 52 and 54, and is positioned so that at least a portion of the mask body intermediate region 22 is unobstructed by the absorbent core 60.

The absorbent core 60 may be made of a variety of different materials. For example, the absorbent core 60 may be made of wood pulp or wood pulp blend nonwoven, for example, tissue airlaid pulp or cellulose. As another example, the absorbent core 60 may be made of a wood pulp or wood pulp blend nonwoven impregnated with super absorbent polymer (SAP). The absorbent polymer core may be made of a woven material such as cotton, a nonwoven material with absorbent characteristics, or a combination of both. As a further example, the absorbent core 60 may be made of peat moss, a known absorbent previously employed as an absorbent core for various products such as diapers, incontinence pads, sanitary napkins and wound dressings. By way of example and not limitation, a typical material weight for the absorbent core 60 is within the approximate range 40 to 80 $gm/m^2$, with a thickness within the approximate range 1 to 10 mil.

The inner layer 54, in particular, the inner facing layer 54, is made of a material designed to "wick" moisture into the absorbent core 60. A wicking material is defined as a material which draws liquid and which allows liquids to be drawn through. More particularly, the inner layer 54 is immediately adjacent the absorbent core 60 and is wicking the side adjacent the absorbent core 60 so as to wick moisture away from the face of a wearer into the absorbent core 60.

As a further refinement, the inner layer 54 preferably is zone treated so as to be hydrophilic in areas of the intermediate region 22, which are overlapped by the absorbent core 60, or zone treated so as to he hydrophobic in areas of the intermediate region 22 which are unobstructed by the absorbent core 60, or both hydrophilic in areas of the intermediate region 22 which are overlapped by the absorbent core, and hydrophobic in the areas of intermediate region 22 which are unobstructed by the absorbent core 60.

Various mask facing materials by their very nature (composition or structure) can either be hydrophilic (naturally moisture-absorbent) or hydrophobic (naturally moisture-repellant). Hydrophilic materials, though naturally absorbent, can be treated or altered through chemical additives or material manufacturing process changes to be repellent. Correspondingly, hydrophobic materials, though naturally repellent, can be treated or altered through chemical additives or material manufacturing process changes to be absorbent.

Further, hydrophilic materials, though naturally absorbent, can be treated or altered through chemical additives, or material manufacturing process changes to be even more absorbent than they are in their natural state. Corresponding, hydrophobic materials, though naturally repellent, can be treated or altered through chemical additives, or material manufacturing process changes to be even more repellent than they are in their natural state.

An example of a naturally moisture-repellent material is polypropylene. Polypropylene is naturally repellent as it is a petroleum based material (plastic). An example of a naturally moisture-absorbent material is tissue. Tissue is naturally absorbent as it is a wood pulp based material (paper).

Thus, in order to accommodate end-user personal preferences regarding particular inner facing materials, in accordance with the invention the potential need to redirect (hydrophilic to hydrophobic) or better direct (hydrophilic to more hydrophilic) the natural performance of the material being used for the inner facing 54 is recognized.

Figure 2:
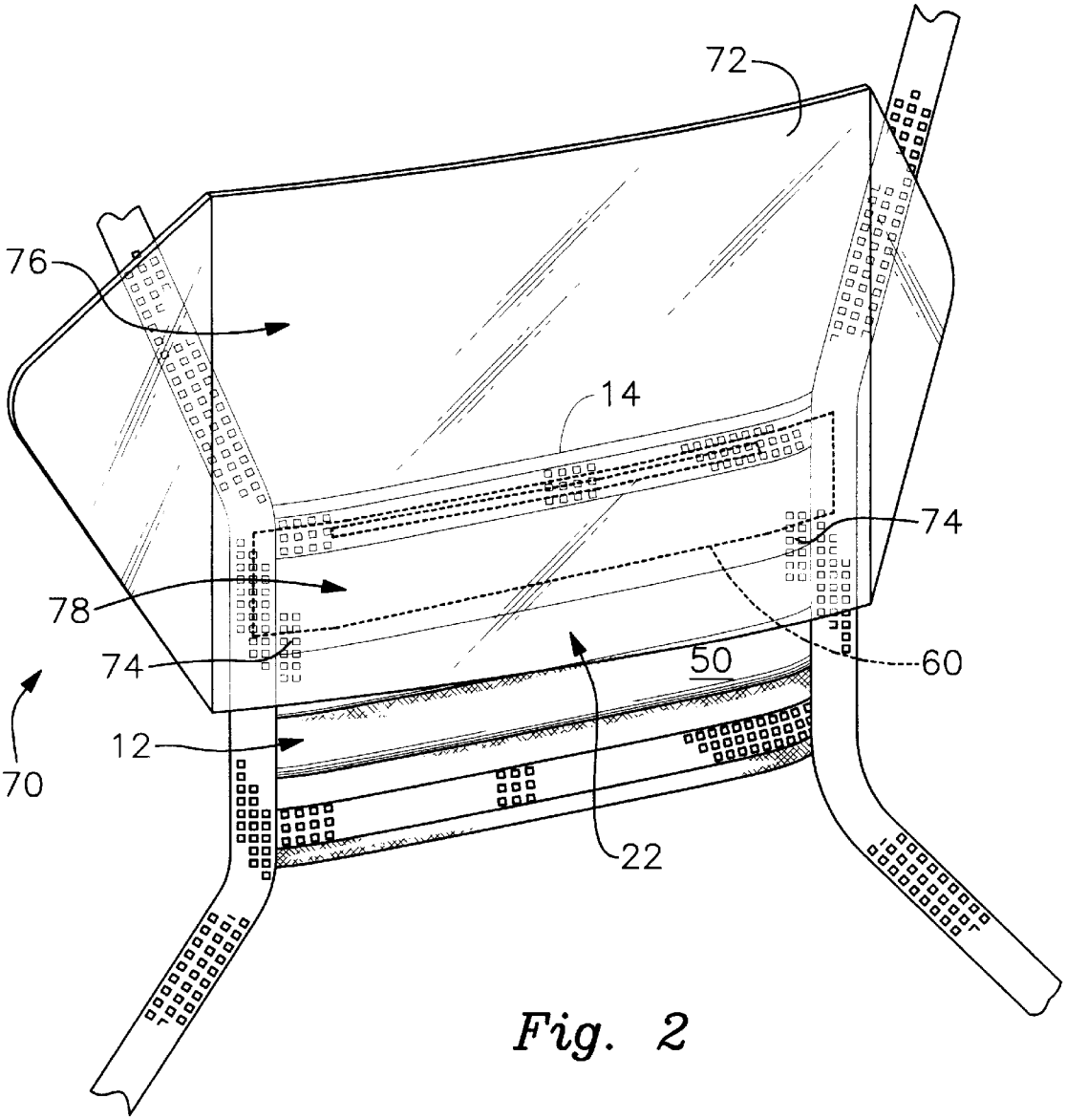
FIG. 2 is a similar three-dimensional view of a mask in accordance with the invention, additionally including a transparent eyeshield.

FIG. 2 depicts another face mask 70, which differs from the face mask 10 of FIG. 1 only in that a transparent plastic eyeshield 72 is incorporated, to protect otherwise-exposed areas of the face, and particularly the eyes, of the wearer, from bodily fluids which may be splashed. The eyeshield 72 is affixed to the mask body 12 on the outside of the outer layer 50 by ultrasonic bonding, as represented by ultrasonic bonding dimples 74. A major portion 76 of the transparent eyeshield 72 extends upwardly past the mask body top 14, and a minor portion 78 of the transparent eyeshield 72 extends downwardly from the mask body top 14 over a portion of the mask body intermediate region 22. In FIG. 2, the absorbent core 60 is positioned adjacent the mask body top 14 within at least a portion of the portion of the mask body intermediate region 22 over which the lower portion 78 of the eyeshield 72 extends.

Figure 5:
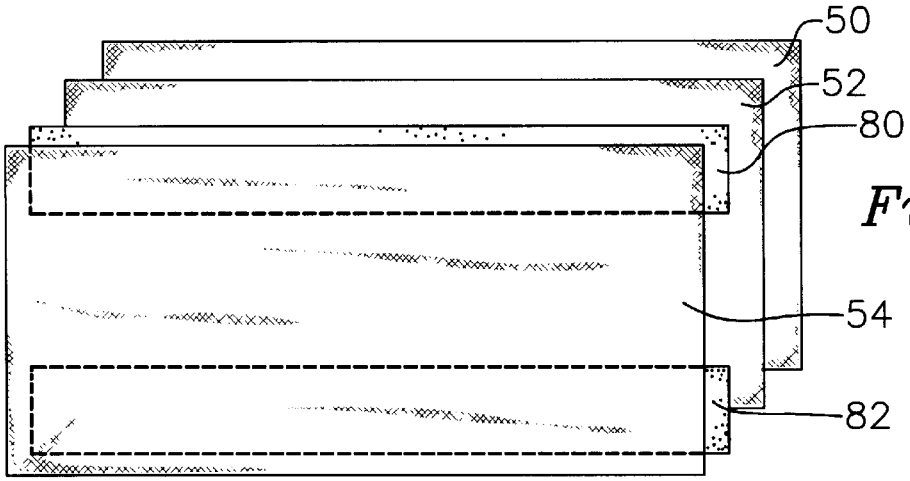
FIG. 5 is an exploded representation of another embodiment, showing the positioning of a pair of absorbent cores at the top and bottom of the face mask.

FIG. 5 represents an alternative embodiment, with different positioning of the absorbent core. In particular, in the embodiment of FIG. 5, there are a pair of absorbent cores 80 and 82, positioned adjacent the mask body top 14 and bottom, respectively. This embodiment provides further absorption of moisture, particularly perspiration, while leaving a sufficient portion of the intermediate region 22 of the mask body unobstructed for breathing.

Figure 6:
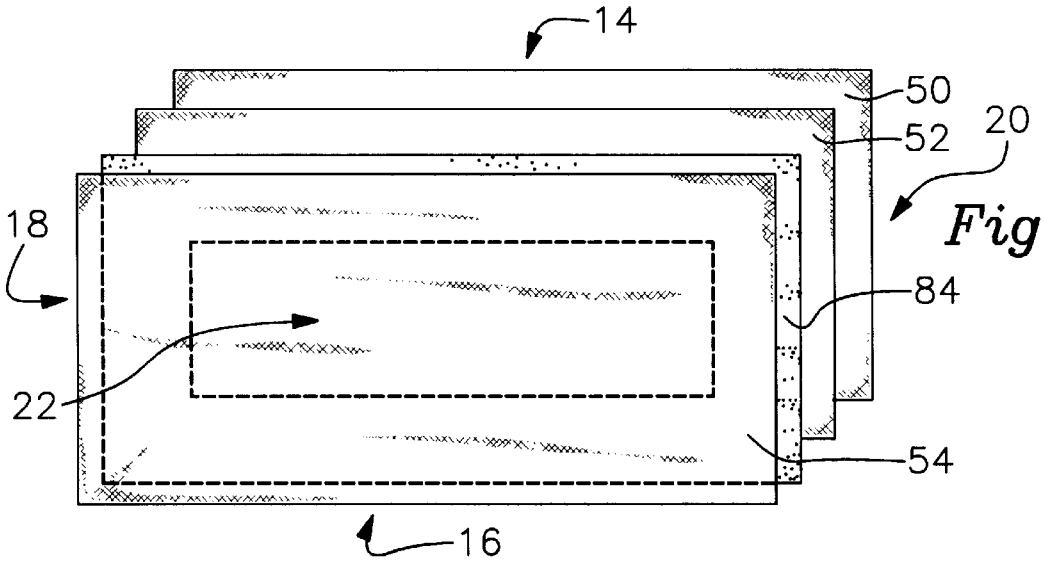
FIG. 6 is an exploded representation of yet another embodiment, including a frame-like absorbent core positioned at the top, bottom and sides of the face mask.

Referring finally to FIG. 6, depicted is yet another absorbent core 84 configuration, which extends in a manner of a frame around the unobstructed portion of the intermediate region 22, adjacent the mask body top 14, bottom 16 and sides 18 and 20. This configuration provides the maximum amount of absorbent core material for maximum absorption of moisture, while still leaving sufficient unobstructed mask area for breathing.

In a typical prior art automated process for manufacturing pleated face masks, a continuous web is provided, in the form of a co-extensive sandwich of outer facing layer 50 material, filter media layer 52 material and inner facing layer 54 material. The width of the web corresponds to the height of the finished masks prior to pleating. In a continuous process, the web is pleated, an ultrasonic "cross-seal" process (across the width of the web) secures the pleats along what subsequently becomes side edges of the finished mask, and the web is cut (again across the width of the web) to define individual mask bodies 12.

To manufacture the embodiments of FIGS. 1–5 described hereinabove, continuous longitudinal strips of absorbent core 60 or 80 and 82 material are included within the continuous web, positioned at the edge of the web (corresponding to the top and bottom of the finished masks), to be subsequently tucked into the pleats as the pleats are formed.

To manufacture the embodiment of FIG. 6, with the frame-like absorbent core 84, a web of absorbent core 84 material is die cut to remove a center corresponding to each individual mask being manufactured, and the entire frame is processed into a pleated mask blank.

In a more sophisticated process, with less material waste, the frame-like absorbent care 84 comprises four discrete sections. Top and bottom sections correspond to the absorbent cores 80 and 82 of FIG. 5, and side sections are separately placed, after pleating, and retained by the "cross-seal."

While specific embodiments of the invention have been illustrated and described herein, it is realized that numerous modifications and changes will occur to those skilled in the art. Thus, it will be appreciated that the positioning of the absorbent core material is not limited to the specific embodiments disclosed herein, although the ones disclosed herein are considered to be the most useful. It is therefore to be understood that the appendant claims are intended to cover all such modifications and changes that fall within the true spirit and scope of the invention.

What is claimed is:

1. A face mask comprising:

a mask body having a top, a bottom, sides and an intermediate region, said mask body including at least an inner layer and a generally coextensive outer layer; and an absorbent core between said inner and outer layers, said absorbent core being of lesser extent in area than said layers and positioned so that at least a central portion of said intermediate region is unobstructed by said absorbent core.

2. The face mask of claim 1, wherein:

said mask body includes an inner facing layer, an intermediate filter media layer generally coextensive with said inner facing layer, and a generally coextensive outer facing layer; and wherein said absorbent core is located between said inner facing layer and said filter media layer.

3. The face mask of claim 1, which further comprises a transparent eyeshield affixed to said mask body on the outside of said outer layer, extending upwardly past said mask body top and downwardly from said mask body top over a portion of said mask body intermediate region.

4. The face mask of claim 3, wherein said absorbent core is positioned adjacent said mask body top within at least a portion of the portion of said mask body intermediate region over which said eyeshield extends.

5. The face mask of claim 1, wherein said absorbent core is positioned adjacent said mask body top.

6. The face mask of claim 1, which further comprises another absorbent core, said absorbent cores being positioned adjacent said mask body top and bottom, respectively.

7. A face mask comprising:

a mask body having a top, a bottom, sides and an intermediate region, said mask body including at least an inner layer and a generally coextensive outer layer; and an absorbent core between said inner and outer layers, said absorbent core being of lesser extent in area than said layers and positioned so that at least a portion of said intermediate region is unobstructed by said absorbent core, said absorbent core extending in the manner of a frame adjacent said mask body top, bottom and sides around the unobstructed portion of said intermediate region.

8. The face mask of claim 1, wherein said absorbent core comprises a material selected from the group consisting of wood pulp, and a wood pulp blend nonwoven, and cotton.

9. The face mask of claim 1, wherein said absorbent core comprises a material selected from the group consisting of wood pulp and a wood pulp blend nonwoven, impregnated with super absorbent polymer (SAP).

10. The face mask of claim 1, wherein said absorbent core comprises peat moss.

11. The face mask of claim 1, wherein said inner layer is immediately adjacent said absorbent core and is wicking from the side adjacent said absorbent core so as to wick moisture away from the face of a wearer into said absorbent core.

12. The face mask of claim 11, wherein said inner layer is selectively zone treated so as to be hydrophilic in areas of said intermediate region which are overlapped by said absorbent core.

13. The face mask of claim 11, wherein said inner layer is selectively zone treated so as to be hydrophobic in areas of said intermediate region which are unobstructed by said absorbent core.

14. The face mask of claim 11, wherein said inner layer is selectively zone treated so as to be hydrophilic in areas of said intermediate region which are overlapped by said absorbent core, and hydrophobic in areas of said intermediate region which are unobstructed by said absorbent core.

15. The face mask of claim 1, wherein said inner layer is selectively zone treated so as to be hydrophilic in areas of said intermediate region which are overlapped by said absorbent core.

16. The face mask of claim 1, wherein said inner layer is selectively zone treated so as to be hydrophobic in areas of said intermediate region which are unobstructed by said absorbent core.

17. The face mask of claim 1, wherein said inner layer is selectively zone treated so as to be hydrophilic in areas of said intermediate region which are overlapped by said absorbent core, and hydrophobic in areas of said intermediate region which are unobstructed by said absorbent core.

* * * * *